US005680977A

United States Patent [19]

Burke

[11] Patent Number: 5,680,977

[45] Date of Patent: Oct. 28, 1997

[54] DISPOSABLE CAMERA STRAP KIT

[76] Inventor: Doyle Gordon Burke, 19807 NE. 160th Pl., Woodinville, Wash. 98072

[21] Appl. No.: 542,048

[22] Filed: Oct. 12, 1995

[51] Int. Cl.[6] ..... A45C 11/38

[52] U.S. Cl. ..... 224/576; 224/257; 224/901; 206/806; 229/117.26

[58] Field of Search ..... 224/576, 584, 224/257, 267, 268, 901, 906, 908, 930; 354/81; 229/117.26; 206/806

[56] References Cited

U.S. PATENT DOCUMENTS

| | | | |
|---|---|---|---|
| 286,654 | 10/1883 | Tobias | 229/117.26 X |
| D. 310,625 | 9/1990 | Arai | D9/305 |
| D. 344,532 | 2/1994 | Takiguchi et al. | D16/208 |
| 4,247,028 | 1/1981 | Maitani et al. | 224/267 |
| 4,386,724 | 6/1983 | Kotler | 224/255 |
| 4,440,334 | 4/1984 | Kappel et al. | 224/268 X |
| 5,045,871 | 9/1991 | Reinholdson | 354/76 |
| 5,328,137 | 7/1994 | Miller et al. | 248/223.4 |
| 5,331,721 | 7/1994 | Raum, Sr. | 224/901 |
| 5,348,206 | 9/1994 | Scherer | 224/257 X |

FOREIGN PATENT DOCUMENTS

| | | | |
|---|---|---|---|
| 15252 | 7/1892 | United Kingdom | 229/117.26 |

*Primary Examiner*—Renee S. Luebke
*Attorney, Agent, or Firm*—Craine & Jackson, P.S.

[57] ABSTRACT

A disposable camera strap kit is provided consisting of a plurality of self-adhesive, display hangers designed for hanging merchandise on a hook, peg or arm attached to a display fixture each of which is placed onto one side or two opposite sides of a disposable camera, and a strap capable of attaching to one or both display hangers to secure the camera around the user's neck or wrist. An optional container is also provided for storing extra display hangers and the strap when not is use.

8 Claims, 1 Drawing Sheet

DISPOSABLE CAMERA STRAP KIT

BACKGROUND OF THE INVENTION

1. Field of the Invention

This invention relates generally to straps, and, more particularly, to straps used to carry a disposable camera.

2. Description of the Related Art

Straps have been used since the advent of portable cameras for carrying a camera from a user's hand, shoulder or neck. Recently, inexpensive, disposable cameras (also known as "single use cameras") have become popular in which the user shoots one roll of film contained in the camera and then turns the camera into a film processor who removes and develops the film. After the developing the film, the camera is either recycled or discarded.

The manufacturing and distribution costs of disposable cameras must be kept sufficiently low in order to compete with reusable cameras. One way to do so, is to eliminate carrying straps. Although most disposable cameras are smaller than reusable cameras and therefore, easier to transport in a pocket or purse, many customers prefer that they have straps. One way to satisfy the conflicting needs of camera manufacturers and customers is to provide a kit which allows a user to attach a removable strap to the disposable camera.

Today, disposable cameras are often displayed in retail stores by suspending them from hooks or pegs attached to a display rack. The hooks and pegs extend through a hole formed either on the outer package of the camera or on a display hanger attached to the side of the camera.

Display hangers, also called hang tabs in the industry, are small square or rectangular-shaped structures measuring approximately 1 inch wide and 1 to 1½ inch long and made of flexible, transparent, plastic sheet material with an upper flap section and a lower base section. The base section has an adhesive layer which allows the display hanger to be attached to the side of disposable camera. The flap section is design to pivot outward from the base section and has a centrally located, round or triangular-shaped hole formed therein through which a peg or channel component on the shelf may be inserted to display the merchandise on the display rack.

SUMMARY OF THE INVENTION

It is an object of the invention to provide a kit which enables a user to selectively attach a strap to a disposable camera.

It is another object of the invention to provide such a kit that is economical to manufacture and use.

It is a further object of the invention to provide such a strap kit which can be used with display hangers currently used in the industry.

These and other objects are met by providing a disposable camera strap kit consisting of a plurality of self-adhesive display hangers designed for hanging merchandise on a hook or peg on a display rack each of which is attached to one side of a disposable camera, a strap capable of attaching to one or both display hangers so that the disposable camera may be both around the user's shoulder, neck or wrist, and a container for storing extra display hangers and the strap when not in use.

DESCRIPTION OF THE PREFERRED EMBODIMENT(S)

Figure 1:
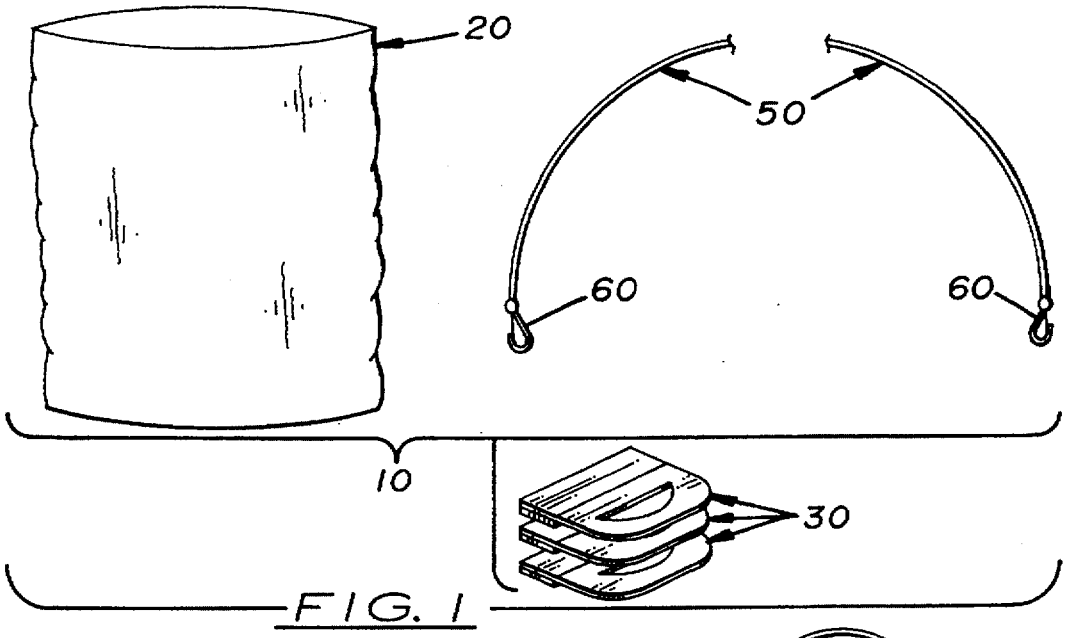
FIG. 1 is a perspective view of the invention showing the various components thereof.

Turning now to the accompanying drawings, in which similar reference characters denote similar elements throughout the several views, FIG. 1 illustrates a disposable camera strap kit 10 that consists of a plurality of self-adhesive display hangers 30, each of which may be selectively attached to one surface on the disposable camera 12 (see FIGS. 2–5). A strap 50 is provided which has an attachment means, such as clasp fasteners 60, attached to each end for attaching the strap 50 to the display hanger 30. An optional container 20 is also provided for storing extra display hangers 30 and the strap 50 when not in use.

The display hangers 30 are small square or rectangular shaped structures measuring approximately 1 inch wide and 1 to 1½ inch long and made of flexible, transparent, plastic sheet material with an upper flap section 32 and a lower base section 36. The base section 36 has an adhesive layer 37 which allows the display hanger 30 to be attached to one side of the disposable camera 12. A removable, protective sheet of paper (not shown) is placed over the adhesive layer 37 which is removed just before attachment to a desired surface. A recess surface 34 is formed between the flap section 32 and the base section 36 which acts as a hinge means therebetween to allow the flap section 32 to pivot outward from the base section 36. The flap section 32 and has a centrally located, round or triangular-shaped hole 38 formed therein through which a peg or channel component on the shelf (not shown) may be inserted to display the merchandise of the display rack. In the preferred embodiment, the display hanger 30 supplied by DO-IT Corporation located in South Haven, Mo., (Catalog No. 261-0116) is used. It should be understood that other types of display hangers may be used in the kit 10.

Figure 3:
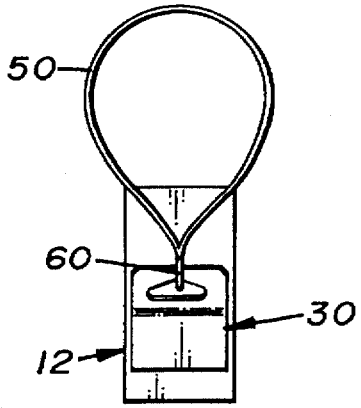
FIG. 3 is a side elevational view of a disposable camera showing one display hanger attached to a side surface thereof and both ends of a strap attached to a single attachment means.
Figure 4:
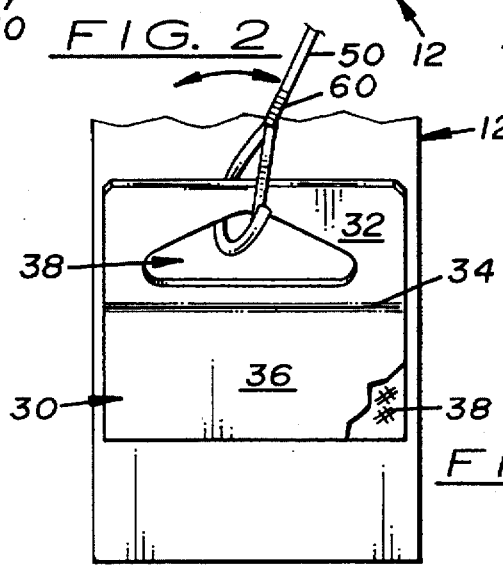
FIG. 4 is partial side elevational view of a disposable camera with one display hanger attached thereto with one end of a strap attached thereto.
Figure 5:
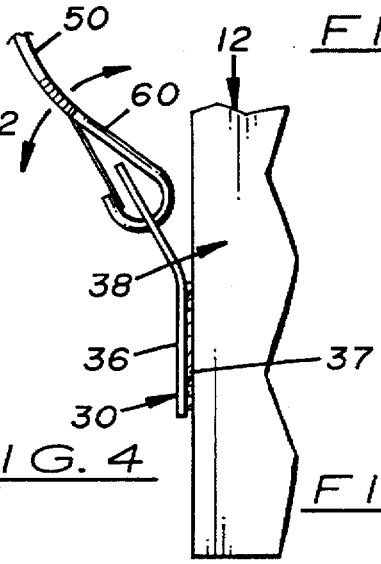
FIG. 5 is a side elevational view of the display hanger and disposable camera shown in FIG. 4.

The strap 50 is made of non-allergenic, non-fade material such as nylon, polypropylene, or leather. Strap 50 measures 6 to 24 inches in length. In the embodiment shown in FIG. 3, both ends of the strap 50 are attached to one clasp fastener 60 to form a closed loop structure. In the embodiment shown in FIG. 4, each end of the strap 50 is attached to a clasp fastener 60. During assembly, the clasp fasteners 60 are attached to the hole 38 manufactured on the display hanger 30. The clasp fastener 60 should be sufficient size so that it can pivot freely on the hole 38 during use as shown in FIGS. 4 and 5.

The container 20 can be any suitable shape and size to store a plurality of display hangers 30 and one strap 50 and can be made of fabric, plastic or paper material.

Figure 2:
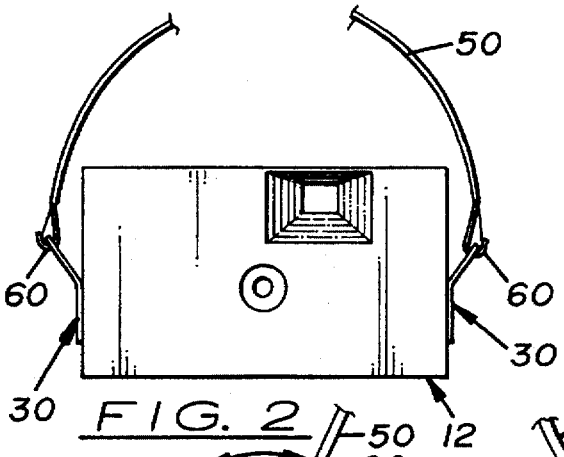
FIG. 2 is a front elevation view of a disposable camera with two display hangers attached to the opposite sides of a disposable camera with a strap attached between them.

During use, one or two display hangers 30 are removed from the container 20. The protective paper is removed from the adhesive layer 37 on each display hanger 30. The display hangers 30 are attached to a desired surface of the disposable camera 12. The actual surface on the disposable camera 12 to which the display hanger 30 is attached depends how the disposable camera 12 is to be carried. For example, the disposable camera 12 is to be carried around the user's neck, one display hanger 30 is attached to each end of the disposable camera 12 with the flap section 32 extending upward. Each end of the strap 50 is attached to a clasp fastener 69 which is attached to a display hanger 30, as shown in FIG. 2. If the disposable camera 12 is to be carried around the user's wrist, one display hanger 30 is attached to one end of the disposable camera. Each end of the strap 50 is attached to clasp fastener 60 which, in turn, is then attached to the display hanger 30, as shown in FIG. 3. When the roll of film in the disposable camera 12 has been exposed, the strap 50 is disconnected from the display hangers 30. The disposable camera 12 can then be turned in for film processing and later, recycled or discarded.

Using the above kit 10, a method for carrying a disposable camera 12 is also disclosed comprising the following steps:

a) selecting at least one display hanger 30 having an upper flap section 32 and a lower base section 36, said base section 36 having an adhesive layer 37 formed thereon which enables said display hanger 38 to be selectively attached to a surface on a disposable camera 12, said flap section 32 having a hole 38 formed therethrough;

b) attaching said display hanger 30 to a disposable camera 12;

c) selecting a strap 50 with an attachment means 69 attached at each end thereof, said attachment means 69 enabling said strap 50 to be selectively attached to said hole 38 on said display hanger 12;

d) attaching each said attachment means 69 on said strap to 50 to at least one said display hanger 30; and, e) carrying said disposable camera 12 using said strap 50.

In compliance with the statute, the invention, described herein, has been described in language more or less specific as to structural features. It should be understood, however, the invention is not limited to the specific features shown, since the means and construction shown comprised only the preferred embodiments for putting the invention into effect. The invention is, therefore, claimed in any of its forms or modifications within the legitimate and valid scope of the amended claims, appropriately interpreted in accordance with the doctrine of equivalents.

I claim:

1. A disposable camera strap kit, comprising in combination:

a) a plurality of self-adhesive display hangers, each said display hanger having an upper flap section and a lower base section, said base section having an adhesive layer formed thereon which enables said display hanger to be selectively attached to a surface on a disposable camera, said flap section having a hole formed which enables a peg or channel component on a display rack to be extended therethrough to display the disposable camera on a display rack;

b) a strap; and, c) an attachment means for selectively attaching and detaching said strap from said hole on said display hanger.

2. A disposable camera strap kit, as recited in claim 1, wherein said attachment means is a clasp fastener attached to each said strap, said clasp fastener being sufficient size to pivot freely when attached to said hole on said display hanger.

3. A disposable camera strap kit, as recited in claim 1, further including a container for storing said display hanger and said strap.

4. A disposable camera strap, as recited in claim 3, wherein said strap is made of non-allergic material.

5. A disposable camera strap kit, as recited in claim 4, wherein said strap is made of nylon material.

6. A disposable camera strap kit, as recited in claim 4, wherein said strap is made of polypropylene material.

7. A disposable camera strap kit, as recited in claim 4, wherein said strap is made of leather.

8. A method for carrying a disposable camera, comprising the following steps:

a) selecting at least one display hanger having an upper flap section and a lower base section, said base section having an adhesive layer formed thereon which enables said display hanger to be selectively attached to a surface on a disposable camera, said flap section having a hole enabling a peg or channel component on a display rack to be inserted therethrough to display the disposable camera on a display rack;

b) attaching said display hanger to a disposable camera;

c) selecting a strap with an attachment means attached at each end thereof, said attachment means enabling said strap to be selectively attached and detached from said hole on said display hanger;

d) attaching each said attachment means on said strap to at least one said display hanger; and, e) carrying said disposable camera using said strap.

* * * * *